US008919670B2

(12) United States Patent
Shivaram

(10) Patent No.: US 8,919,670 B2
(45) Date of Patent: Dec. 30, 2014

(54) INJECTION LANCE WITH VARIABLE SWIRL

(75) Inventor: Pavan Kumar Shivaram, Pittsburgh, PA (US)

(73) Assignee: United States Steel Corporation, Pittsburgh, PA (US)

( * ) Notice: Subject to any disclaimer, the term of this patent is extended or adjusted under 35 U.S.C. 154(b) by 516 days.

(21) Appl. No.: 13/315,633

(22) Filed: Dec. 9, 2011

(65) Prior Publication Data

US 2013/0146680 A1 Jun. 13, 2013

(51) Int. Cl.

| | |
|---|---|
| ***B05B 7/10*** | (2006.01) |
| ***B05B 1/34*** | (2006.01) |
| ***C21B 7/16*** | (2006.01) |

(52) U.S. Cl.

USPC ..... 239/406; 239/403; 239/405; 239/422; 239/423; 239/487; 266/221; 266/222; 266/225; 266/267

(58) Field of Classification Search

CPC ..... C21B 5/001; C21B 5/003; C21B 7/16; C21B 7/163; B05B 1/34; B05B 1/3405; B05B 1/341; B05B 1/3415; B05B 1/3431; B05B 1/3447

USPC ..... 239/8, 132.3, 398–400, 403, 405–407, 239/413, 416.2–416.5, 417.5, 418, 422, 239/423, 428, 433, 463, 487, 489; 266/47, 266/217, 218, 221, 222, 225, 226, 266–268

See application file for complete search history.

(56) References Cited

U.S. PATENT DOCUMENTS

| | | | | |
|---|---|---|---|---|
| 2,454,892 | A * | 11/1948 | Sprow | 266/266 |
| 3,321,139 | A * | 5/1967 | de Saint Martin | 239/132.3 |
| 5,333,840 | A | 8/1994 | Skold et al. | |
| 5,451,034 | A * | 9/1995 | Ulveling et al. | 266/182 |
| 6,319,458 | B1 * | 11/2001 | Jung et al. | 266/266 |
| 2008/0134838 | A1 * | 6/2008 | Memoli et al. | 75/553 |
| 2010/0001443 | A1 * | 1/2010 | Kroemmer et al. | 266/268 |
| 2011/0180978 | A1 | 7/2011 | Goedert et al. | |

FOREIGN PATENT DOCUMENTS

| | | |
|---|---|---|
| EP | 1060272 | 12/2000 |

OTHER PUBLICATIONS

DOE/MC/23762-4073 Blast Furnace Granulated Coal Injection System Demonstration Project Public Design Report, Topical Report, Mar. 1995, by Bethlehem Steel Corporation, Bethlehem, Pennsylvania.

* cited by examiner

*Primary Examiner* — Darren W Gorman

(74) *Attorney, Agent, or Firm* — McNees Wallace & Nurick LLC

(57) ABSTRACT

A fuel injection lance for an ore-smelting furnace includes a central conduit, a first conduit and a second conduit. The first and second conduits are concentric with the central conduit. A central conduit is connected to a fuel mixture. The first and second conduits are in flow communication with a gas source. The first and second conduits have gas flowing at independently controllable gas flow rates relative to the other conduit. A swirl portion has a cylindrical body with a hollow interior cylinder, and vertical and helical channels formed within the body portion. Vertical channels traverse the body portion vertically to the outer surface adjacent to the bottom surface. Helical channels traverse the outer surface in a helical pattern. Vertical channels intersect with corresponding helical channels at a predetermined angle selected to provide a desired particle distribution of a fuel injected into the furnace.

16 Claims, 5 Drawing Sheets

INJECTION LANCE WITH VARIABLE SWIRL

BACKGROUND

The application generally relates to an apparatus and method for feeding pulverized coal into a blast furnace through a pulverized coal injection lance. The application relates more specifically to a pulverized coal injection lance for controlling the swirl parameter of a gas flow to vary dispersion of coal particles injected through the injection lance, and a method for varying the dispersion of coal particles injected using the injection lance.

In metallurgical ore smelting operations, fuel and combustion gases may be supplied to a blast furnace through injection lances that end in tuyeres, which deliver a blast of air into a blast furnace. Pulverized coal injection lances are generally used to inject pulverized coal as a substitute to coke into a blast furnace. Pulverized coal is conveyed pneumatically through the injection lance and fed into an oxidizing atmosphere in a tuyere, through which hot blast air is blown into the furnace. To ensure that the pulverized coal burns completely the combustion reaction should begin as close to the lance tip as possible. Oxycoal lances exist that consist of an inner pipe for conveying the pulverized coal and a concentric outer pipe for conveying combustive gas, generally pure oxygen.

It has been found, however, that the flame at the lance tip is not stable and does sporadically go out. In some cases, the flame can automatically reignite without intervention. This can however not be guaranteed. If the combustion of the pulverized coal does not take place at the lance tip because the flame has extinguished, the pulverized coal and the oxygen are fed into the blast furnace, and complete burning of the pulverized coal cannot be guaranteed.

A number of solutions have been proposed to improve the burning efficiency at the lance tip, generally by improving the mixing of the pulverized coal and oxygen. For example, EP 1060272 describes that the burning of the pulverized coal can be improved and the flame maintained by providing a flow swirler between the coaxial pipes so as to impart a swirling motion to the oxygen fed to the lance tip. The effect of the flow swirler depends on the structure of the lance. If the spiral angle is too deep, the oxygen is directed away from the pulverized coal and the burning efficiency is decreased. If the spiral angle is too shallow, the improvement of the burning efficiency is negligible. The swirl ratio is geometry dependent and hence constant for the flow swirler lance, particularly since there is only one feeder channel for the oxygen.

Another proposed solution is described in U.S. Published Patent Application No. 2011/0180978 provides a pulverized coal injection lance having an inner pipe for conveying pulverized coal and an outer pipe, coaxially arranged around the inner pipe, for conveying combustive gas. The inner pipe forms a separation wall that separates the pulverized coal from the combustive gas. The pulverized coal injection lance includes a lance tip arranged in the tuyere that allows pulverized coal and combustive gas to form a mixture of at the lance tip, while ensuring that the flame is maintained at the lance tip. The coaxial pipe coal injection lance does not provide any capability for imparting swirl into the fuel train, and therefore no means for varying a swirl ratio.

What is needed is an injection lance that provides a desired distribution of coal particles that may be varied. Different smelting plants may have different requirements relative to their specific geometries and furnace operating conditions. In each of these cases, it may be possible to obtain a similar distribution of particles by changing the proportion of the air that enters the ports, if there were multiple gas flow channels.

It may also be possible to achieve a change in the maximum possible swirl ration by changing the exit angle of helical ports.

Intended advantages of the disclosed systems and/or methods satisfy one or more of these needs or provide other advantageous features. Other features and advantages will be made apparent from the present specification. The teachings disclosed extend to those embodiments that fall within the scope of the claims, regardless of whether they accomplish one or more of the aforementioned needs.

SUMMARY

One embodiment relates to a swirl portion of a fuel injection lance for an ore-smelting furnace. The swirl portion includes a cylindrical body portion, a top surface, a bottom surface an outer surface. A hollow interior cylinder extends through the body portion along a center axis. Vertical channels and helical channels are formed within the body portion. The vertical channels enter the body portion at the top surface at a radial distance intermediate the interior cylinder and the outer surface. Vertical channels traverse the body portion vertically to the outer surface adjacent to the bottom surface. Helical channels traverse the outer surface between the top surface and the bottom surface in a helical pattern. Each vertical channel intersects with a corresponding helical channel adjacent the bottom surface at a predetermined angle selected to provide a desired particle distribution of a fuel injected into the furnace.

Another embodiment relates to a fuel injection lance for an ore-smelting furnace. The fuel injection lance includes three or more pipes arranged to define a central conduit, a first conduit and a second conduit. The first conduit and the second conduit are concentrically arranged relative to an axis of the central conduit. The central passage is connected to a fuel source made up of a solid particulate entrained in a fluid gas stream. The first and second conduits are in flow communication with a gas source. The first and second conduits have gas flowing therethrough at independently controllable gas flow rates relative to the other conduit. A swirl portion of the fuel injection lance includes a cylindrical body portion, a top surface, a bottom surface an outer surface. A hollow interior cylinder extends through the body portion along a center axis. Vertical channels and helical channels are formed within the body portion. The vertical channels enter the body portion at the top surface at a radial distance intermediate the interior cylinder and the outer surface. Vertical channels traverse the body portion vertically to the outer surface adjacent to the bottom surface. Helical channels traverse the outer surface between the top surface and the bottom surface in a helical pattern. Each of the vertical channels intersects with a corresponding one of the helical channels adjacent the bottom surface at a predetermined angle. The predetermined angle is selected to provide a desired particle distribution of a fuel injected into the furnace through a tuyere portion.

In yet another embodiment a method for injecting fuel into an ore-smelting furnace using an injection lance is disclosed. The method includes the steps of: providing at least a central conduit, a first conduit and a second conduit; injecting a solid fuel particulate entrained in a gas flow through the central conduit; injecting a first gas flow at a first gas flow rate in the first conduit; injecting a second gas flow at a second gas flow rate in the second conduit; directing the first gas flow into a vertical channel at an end of the first conduit; directing the second gas flow into a helical channel at an end of the second conduit; and combining the first gas flow and the second gas flow at a distal end of the respective vertical channel and helical channel adjacent to an end of the center conduit.

Certain advantages of the embodiments described herein are the ability to vary a swirl ratio of an injection lance by adjusting gas flow in two adjacent gas flow conduits, while maintaining a constant total momentum of the fuel, such as pulverized coal. The injection lance also provides varying swirl ratios using the same geometry of the injection lance.

Alternative exemplary embodiments relate to other features and combinations of features as may be generally recited in the claims.

DETAILED DESCRIPTION OF THE EXEMPLARY EMBODIMENTS

Figure 1:
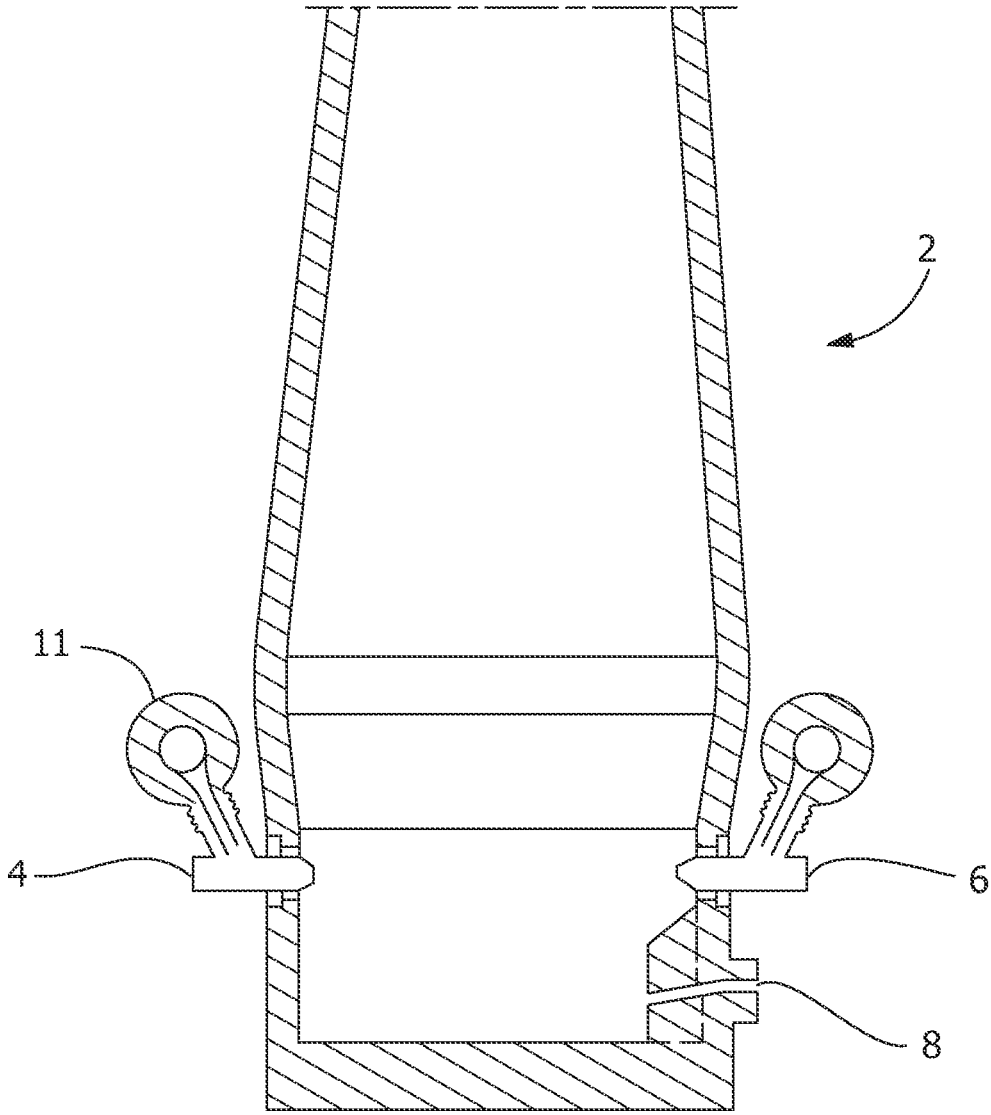
FIG. 1 is a schematic diagram of an exemplary blast furnace with tuyere and injection lance arrangement.

Referring first to FIG. 1, an exemplary blast furnace 2 used in smelting ores is shown. A burden of ore and, if desired, a limited quantity of coke can be added from the top of the shaft furnace 2. Furnace 2 may be equipped with blast pipe and tuyere arrangements 4, 6 as shown in the figure. The blast pipe and tuyere arrangements are preferably supplied with hot blast from a circular distributing pipe 11. Also, by means of the blast pipe and tuyere arrangements, a combination of oxygen and fuel, such as coal, can be injected into the furnace, to burn in the furnace to smelt the ore and produce iron. An injection lance may be introduced into a wall of the blast pipe to inject air and fuel into the furnace, to burn in the furnace to smelt the ore and produce iron. The iron can then be tapped at the bottom opening 8.

Figure 2:
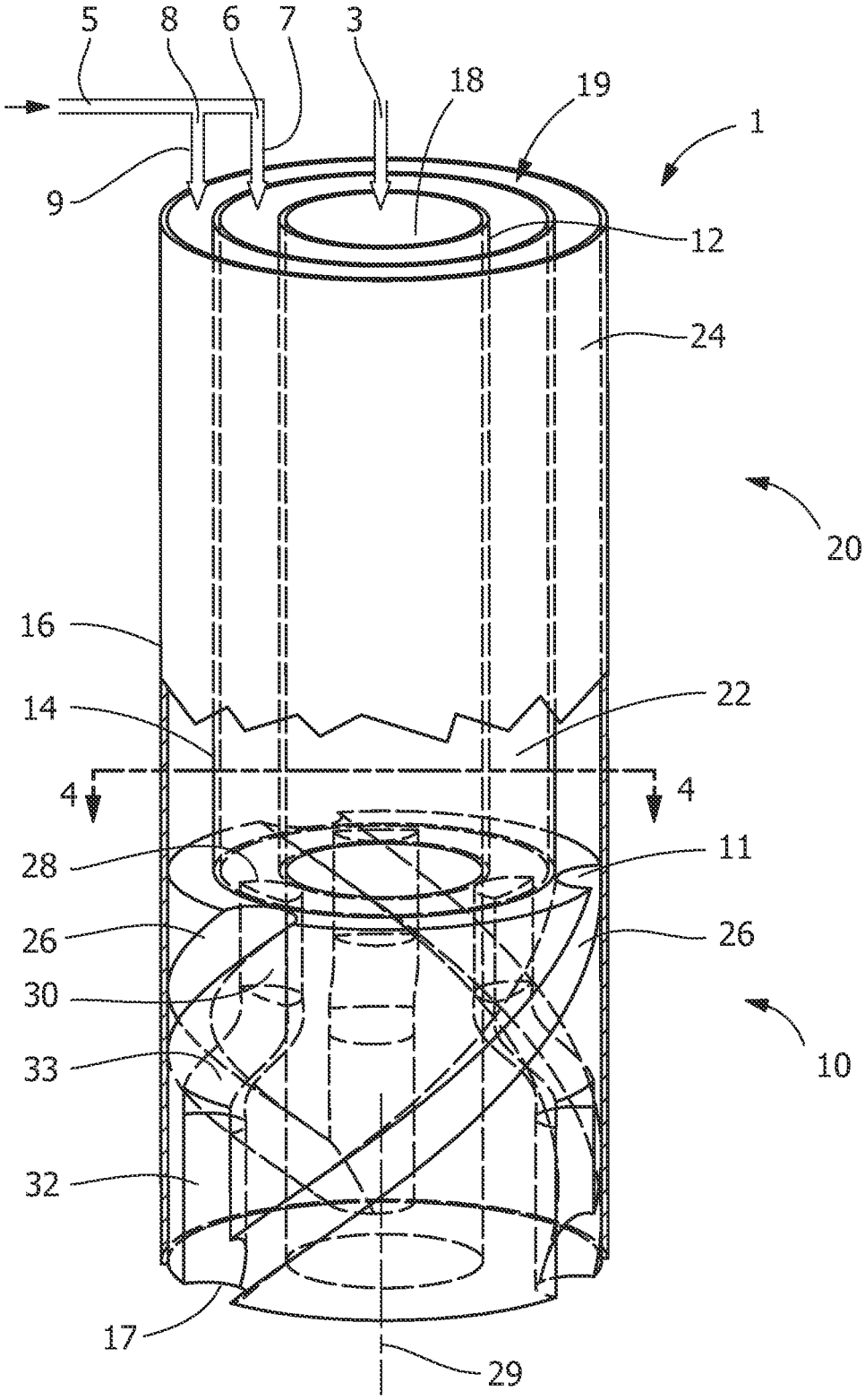
FIG. 2 is a fragmentary elevational view of an exemplary embodiment of a pulverized coal injection lance.

FIG. 2, an exemplary injection lance is generally indicated as 1. Injection lance 1 includes a top portion 20 and a bottom portion 10. Bottom portion 10 may be alternately referred to as swirl section. Top portion 20 includes three hollow cylinders, a first cylinder 12, a second cylinder 14 and a third cylinder 16. First cylinder 12, second cylinder 14 and third cylinder 16 are arranged coaxially and concentrically. First cylinder 12 is disposed along the entire interior of injection lance 1, defining a central bore 18 of lance 1. First cylinder is arranged to conduct a flow 3 of solid fuel, e.g., pulverized coal, entrained in a carrier gas, e.g., nitrogen. Second cylinder 14 is disposed on the outer side of first cylinder 12 and defines a first annular passageway 22. Second cylinder 14 extends from an inlet end 19 of lance 1 to top surface 11 of bottom portion 10. Third cylinder 16 is disposed on the outer side of second cylinder 14 and defines a second annular passageway 24. Third cylinder 16 extends substantially the length of lance 1, forming an external sleeve around bottom portion 10. In FIG. 2, the bottom half of third cylinder 16 is partially cut away for clarity, to show features of bottom portion 10, second cylinder 14, and other details of injection lance 1. Second passageway 24 extends from inlet end 19 to top surface 11. Gas supply line 5 conducts gas to first passageway feed line 7 through valve 6, and to second passageway feed line 9 through valve 8. Air or gas of any desired composition may be fed into first and second passageways 22, 24 through supply line 5.

Figure 3:
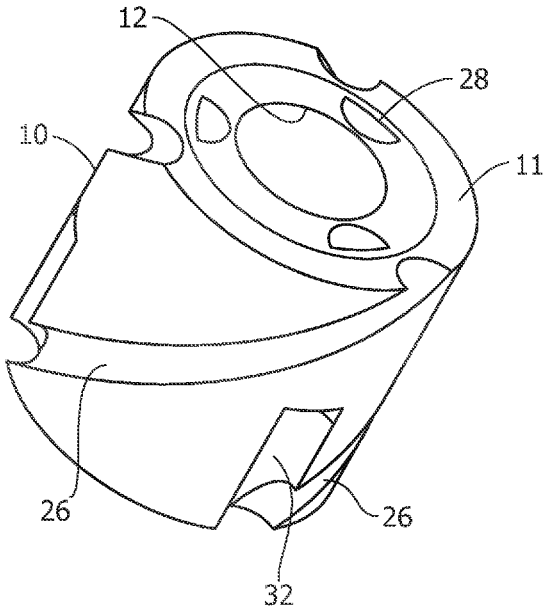
FIG. 3 is an isometric view of a swirl portion of the injection lance.
Figure 5:
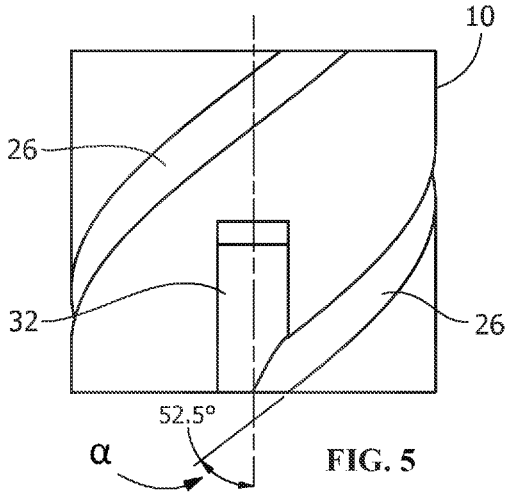
FIG. 5 is a side elevational detailed view of the swirl portion of FIG. 4.

For a blast furnace application, lance 1, and especially bottom portion 10, is constructed of a material that can resist high temperatures to withstand heat from the hot gases in the furnace tuyeres (not shown). Referring next to FIG. 3, bottom section 10 includes helical channels 26 through which a gas, e.g., compressed air, is directed. Helical channels 26 are formed in an outer wall of bottom portion 10 in a helical path extending from top surface 11 to outlet end 17. Channels 26 may be semi-circular in cross section to help impart a desired swirl pattern to the gas as the air travels through channels 26. In one embodiment, the diameter of the semi-circular region may be approximately 0.13 inch. The center line through the helical channels 26 defines an angle $\alpha$ with axis 29 of lance 1 (See FIG. 5). Preferably, angle $\alpha$ is 52.5°. Angle $\alpha$ may be greater or less than 52.5° if desired, depending on the maximum extent of swirl required. For the design shown in the figures, angle $\alpha$ is preferably 52.5°. Helical channels revolve about 100° of the outer circumference of bottom portion 10 through approximately 1.5 inches of axial length. Angle $\alpha$ determines the fraction of angular momentum that is generated in the air stream passing through channels 26. Various parameters, including the channel size, the swirl exit angle and length of helical channels 26, can be modified based on specific air flow and fuel particle distribution requirements, and the disclosure is not limited to the exemplary dimensions set forth above, but encompasses a broad range of dimensions.

A second set of channels 28 is formed in bottom portion 10. Each channel 28 may also have a semi-circular cross section of comparable dimensions with those of helical channels 26. In top surface 11 of bottom portion 10, channels 26 begin adjacent to the periphery of first cylinder 12. Channels 28 may consist of a first vertical section 30 at the beginning of bottom portion 11, a second vertical section 32 along the outside surface of bottom portion 11. Second vertical section 32 ends adjacent to the end of helical channels 26. The two channels combine to exit the bottom portion 10 through section 34 (See FIG. 4B). A transition section 33 connects vertical sections 30 and 32, transition section 33 extending between first vertical section 30 near the inner radius of top surface 11 to the second vertical section 32 at the outer perimeter of bottom portion 11, thus connecting the two straight vertical sections 30, 32 in flow communication.

On top portion 20 second cylinder 14 rests against top surface 11 to form a wall separating the inlets of helical channels 26 from the inlets of channels 28. Lance 1 including top portion 20 and bottom portion 10 is enclosed by third cylinder 16, wherein the outer surface of bottom portion 10 is flush with the inner walls of the outer cylinder thus preventing gas or air flowing in helical channels 26 from mixing with gas or air flowing in channels 28. Third cylinder 16 extends in length such that the end of the bottom portion 10 and third cylinder 16 are substantially aligned Annular cylindrical passageways 22, 24 formed at top portion 20 are gas passageways. Gas passageways 22, 24 receive gas from passageway feed line 5 that is split into individual passageway feed lines 7, 9, for annular passageways 22, 24, respectively. A first flow metering valve 6 is provided between main gas feed line 5 and first feed line 7 feeding gas to first annular passageway 22. A second flow metering valve 8 is provided between main gas feed line 5 and second feed line 9 feeding gas to second annular passageway 24. Flow metering valves 6, 8 on separate feed lines 7, 9 allow the user to vary the proportion of the total gas that is fed to passageways 22, 24. By varying the proportional gas flowing in passageways 22, 24, the desired amount of swirl may be generated without varying the total flow rate of the main gas in main feed line 5. Metering valves may be any suitable type of valve, including automatic or manually adjustable valves, and may be operated manually or by an automated or computerized control system, e.g., programmable automation controller (PAC), programmable logic controller (PLC) or distributed control system (DCS, personal computer (PC), or similar device. Also, in an alternate embodiment, the flow proportions may be varied using only one metering valve 6 or 8 to control the relative flows, e.g., a proportional valve.

Swirling flows are generally characterized by a non-dimensional number S, also referred to as 'Swirl Number'. S is defined as the ratio of angular momentum to the linear momentum. In the current study, the swirl number is calculated, at the exit section 34, in equation 1 as follows:

$$S = \frac{\int_{r_{min}}^{r_{max}} \rho r w \vec{v} \cdot d\vec{A}}{\bar{R}\int_{r_{min}}^{r_{max}} \rho u \vec{v} \cdot d\vec{A}} \equiv \frac{\text{Mass weighted average of } (r \times w)}{\bar{R} \times \text{Mass weighted average of } (u)}$$

Figure 4A:
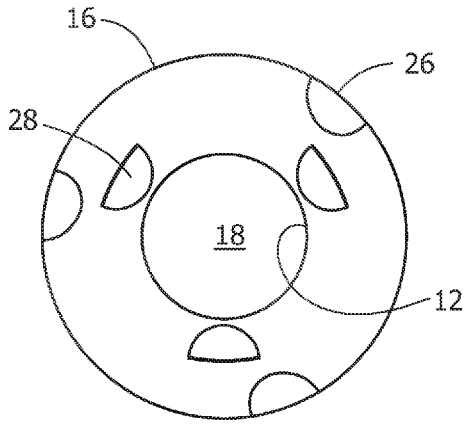
FIG. 4A is a plan view of the swirl portion taken along lines 4A-4A in FIG. 2.
Figure 4B:
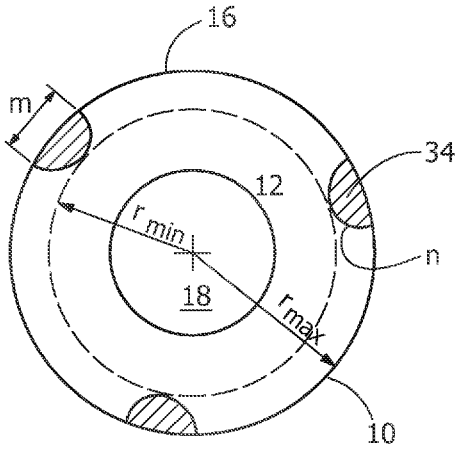
FIG. 4B is a plan view of the swirl portion taken along lines 4B-4B in FIG. 2.

Wherein:

u=the axial velocity of the gas exiting the bottom portion 10 (swirl section) through section 34, w=the tangential velocity of the gas exiting bottom portion 10 through section 34, v=the velocity magnitude of the gas exiting bottom portion 10 through section 34, ρ=Density of the gas exiting bottom portion 10 through section 34, $\vec{v}.d\vec{A}$=dot product of the facet area vector and the facet velocity vector calculated at the shaded region 34 shown in FIG. 4B, $r_{min}$=radius of the imaginary circle touching the inner edge of the shaded regions (section 34) as shown in FIG. 4B, $r_{max}$=radius of the imaginary circle touching the outer edge of the shaded regions (section 34) as shown in FIG. 4B, and $\bar{R}$=the hydraulic radius of section 34, shown shaded in FIG. 4B, Note that the hydraulic radius $\bar{R}$ of section 34 in FIG. 4B is calculated as:

$$\bar{R} = \frac{4A}{P}$$

Wherein, $P=m+n$

A=the cross sectional area of the shaded region 34, where the helical and straight channels exit section 10 as shown in FIG. 4B, P=the perimeter of the shaded region in FIG. 4B, m=arc length along open periphery of shaded region shown in FIG. 4B, and n=arc length along interior cross section of shaded region shown in FIG. 4B S is calculated at the exit of the ports by integrating over the limits of a minimum radius $r_{min}$ and a maximum radius $r_{max}$.

For prior art lances, S is geometry dependent and hence constant for each injection lance. For this novel design S is variable by adjusting the flow rates passing through vertical channels 32 and helical channels 26. Increased flow rate through vertical channels 32 relative to the flow rate in helical channels 26 reduces the value of S. Conversely, a higher flow rate through the helical channels 26 relative to the flow rate in vertical channels 32 results in an increased value of S. Thus, flows in vertical channels 32 and helical channels 26 may be adjusted relative to one another to provide a range of S, from very low swirl regimes to high swirl regimes ($0 \leq S \geq 0.85$), using the geometry shown in the FIGS. 2-5.

Figure 6:
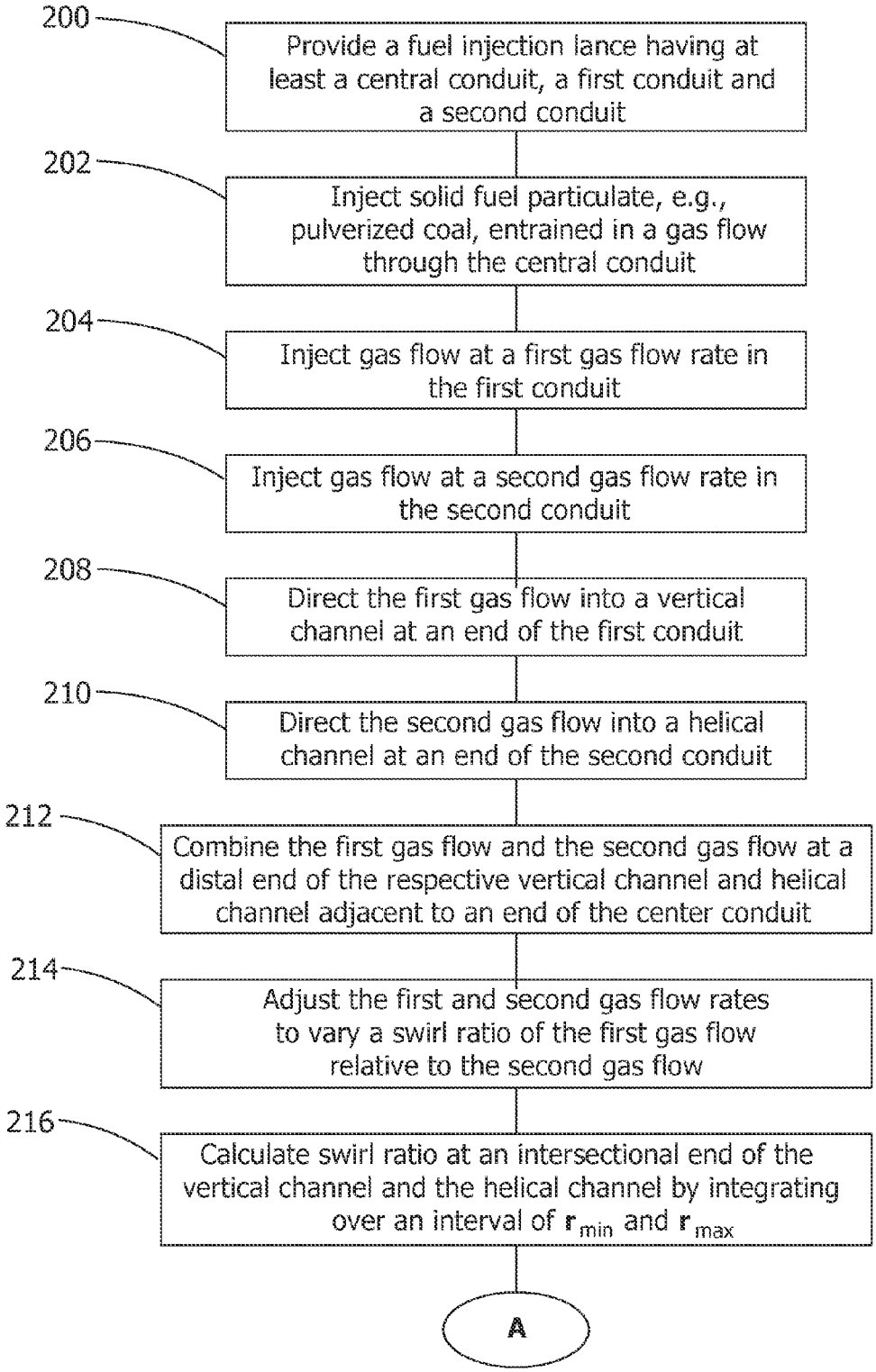
FIGS. 6 and 6A show an exemplary implementation of a method using the injection lance of FIGS. 1-5.
Figure 6A:
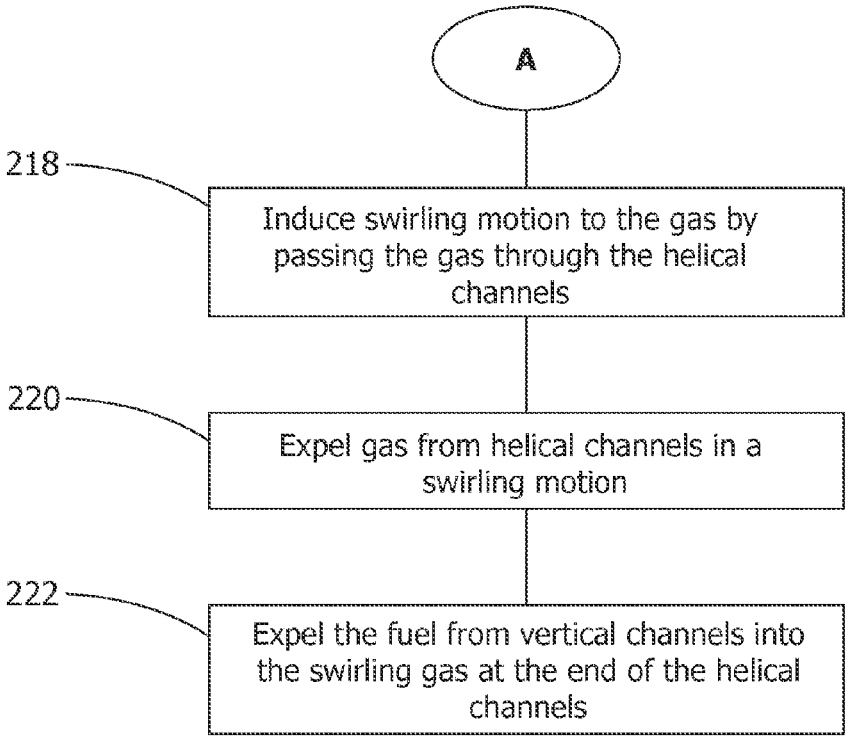

Referring next to FIGS. 6 and 6A, a method is disclosed in which the injection lance 1 is used to apply an adjustable swirl ratio to the fuel flowing into the ore-smelting furnace. First, at step 200, the method begins by providing a fuel injection lance having at least a central conduit, a first conduit and a second conduit. The method proceeds to step 202, to inject a solid fuel particulate, e.g., pulverized coal, entrained in a gas flow through the central conduit. At step 204, the method injects gas flow at a first gas flow rate in the first conduit. Then, at step 206, inject gas flow at a second gas flow rate in the second conduit. At step 208, the method directs the first gas flow into a vertical channel at an end of the first conduit. Then, at step 210, direct the second gas flow into a helical channel at an end of the second conduit. At step 212, the first gas flow and the second gas flow are combined at a distal end of the respective vertical channel and helical channel adjacent to an end of the center conduit. The method proceeds, at step 214, to adjust the first and second gas flow rates to vary a swirl ratio of the first gas flow relative to the second gas flow. Next, at step 216, swirl ratio at an intersectional end of the vertical channel and the helical channel is calculated by integrating over an interval of $r_{min}$ and $r_{max}$. At step 218, swirling motion is induced to the gas by passing the gas through the helical channels. At step 220, gas is expelled from helical channels in a swirling motion. Finally, at step 222, the fuel from vertical channels is expelled into the swirling gas at the end of the helical channels.

It should be understood that the application is not limited to the details or methodology set forth in the following description or illustrated in the figures. It should also be understood that the phraseology and terminology employed herein is for the purpose of description only and should not be regarded as limiting.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

The present application contemplates methods, systems and program products on any machine-readable media for accomplishing its operations. The embodiments of the present application may be implemented using an existing computer processors, or by a special purpose computer processor for an appropriate system, incorporated for this or another purpose or by a hardwired system.

It is important to note that the construction and arrangement of the injection lance as shown in the various exemplary embodiments is illustrative only. Although only a few embodiments have been described in detail in this disclosure, those who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

It should be noted that although the figures herein may show a specific order of method steps, it is understood that the order of these steps may differ from what is depicted. Also two or more steps may be performed concurrently or with partial concurrence. Such variation will depend on the software and hardware systems chosen and on designer choice. It is understood that all such variations are within the scope of the application. Likewise, software implementations could be accomplished with standard programming techniques with rule based logic and other logic to accomplish the various connection steps, processing steps, comparison steps and decision steps.

What is claimed is:

1. A swirl portion of a fuel injection lance for an ore-smelting furnace, the swirl portion comprising:

a cylindrical body portion, a top surface, a bottom surface, an outer surface, and a hollow interior cylinder extending through the body portion along a center axis; and a plurality of vertical channels and a plurality of helical channels formed within the body portion;

each of the vertical channels entering the body portion at the top surface at a radial distance intermediate the interior cylinder and the outer surface, and traversing the body portion vertically to the outer surface adjacent the bottom surface;

each of the helical channels traversing the outer surface between the top surface and the bottom surface in a helical pattern, each of the vertical channels intersecting with a corresponding one of the helical channels adjacent the bottom surface at a predetermined angle selected to provide a desired particle distribution of a fuel injected into the furnace.

2. The swirl portion of claim 1, wherein the vertical channels are configured to receive a gas flowing therethrough at a first flow rate from a gas supply, and the plurality of helical channels are configured to receive the gas flowing therethrough at a second flow rate from the gas supply, the first flow rate and the second flow rate being variable to adjust a swirl ratio for determining a fuel particle distribution at a discharge end of the injection lance.

3. The swirl portion of claim 2, wherein the swirl ratio S is defined as a ratio of an angular momentum of the gas flow to a linear momentum of the gas flow, the swirl number S calculated according to:

$$S = \frac{\int_{r_{min}}^{r_{max}} \rho r w \vec{v} \cdot d\vec{A}}{\bar{R} \int_{r_{min}}^{r_{max}} \rho u \vec{v} \cdot d\vec{A}} \equiv \frac{\text{Mass weighted average of } (r \times w)}{\bar{R} \times \text{Mass weighted average of } (u)}.$$

4. The swirl portion of claim 1, wherein each of the helical channels and vertical channels comprises a semi-circular cross section to impart a desired swirl pattern to a gas flow passing through the channels.

5. The swirl portion of claim 4, wherein the diameter of the semi-circular cross section is about 0.13 inch.

6. The swirl portion of claim 1, wherein a center line through each helical channel defines an angle $\alpha$ with respect to the center axis of body portion.

7. The swirl portion of claim 6, wherein the angle $\alpha$ is 52.5° .

8. The swirl portion of claim 1, wherein each helical channel revolves about 100° of the outer surface of the swirl portion.

9. The swirl portion of claim 8, wherein the helical channels extend over about 1.5 inches of axial length.

10. The swirl portion of claim 6, wherein angle a determines a fraction of angular momentum generated in a gas flow passing through helical channels.

11. The swirl portion of claim 1, wherein the vertical channels have a semi-circular cross section.

12. The swirl portion of claim 1, wherein the vertical channels enter the top surface adjacent to the interior cylinder wherein each vertical channel further comprises:

a first vertical section at the top surface of swirl portion, a second vertical section disposed at the outer surface the second vertical section adjacent to an end of a corresponding helical channel; and a transition section interconnecting the first vertical section and the second vertical section in flow communication.

13. The swirl portion of claim 1, wherein the helical channels comprise parameters modified based on a specific air flow and a fuel particle distribution requirements, the parameters including one or more of a channel size, a swirl exit angle and a length of the respective helical channel.

14. A fuel injection lance for an ore-smelting furnace, the fuel injection lance comprising:

at least three pipes arranged to define a central conduit, a first conduit and a second conduit, the first conduit and the second conduit concentrically arranged relative to an axis of the central conduit;

the central conduit connected to a fuel source comprising a solid particulate entrained in a fluid gas stream, and each of the first conduit and the second conduit in flow communication with a gas source;

the first and second conduit each having gas flowing therethrough respectively at independently controllable gas flow rates relative to the other conduit; and a swirl portion comprising:

a cylindrical body portion, a top surface, a bottom surface and an outer surface, the central conduit extending through the body portion; and a plurality of vertical channels and a plurality of helical channels formed within the body portion, the vertical channels in flow communication with the first conduit and the helical channels in flow communication with the second conduit;

each vertical channel of the plurality of vertical channels entering the body portion at the top surface at a radial distance intermediate the central conduit and the outer surface, and traversing the body portion vertically to the outer surface adjacent the bottom surface;

each of the helical channels traversing the outer surface between the top surface and the bottom surface in a helical pattern, each of the vertical channels intersecting with a corresponding one of the helical channels adjacent the bottom surface at a predetermined angle, the predetermined angle selected to provide a predetermined particle distribution of a fuel injected into the furnace through a tuyere portion.

15. The fuel injection lance of claim 14, wherein the vertical channels are configured to receive a gas flowing therethrough at a first flow rate from the gas source, and the helical channels are configured to receive the gas flowing therethrough at a second flow rate from the gas source, the first flow rate and the second flow rate being variable to adjust a swirl ratio for determining a fuel particle distribution at a discharge end of the injection lance.

16. The swirl portion of claim 15, wherein the swirl ratio S is defined as a ratio of an angular momentum of the gas flow to a linear momentum of the gas flow, the swirl number S calculated according to:

$$S = \frac{\int_{r_{min}}^{r_{max}} \rho r w \vec{v} \cdot d\vec{A}}{\bar{R} \int_{r_{min}}^{r_{max}} \rho u \vec{v} \cdot d\vec{A}} \equiv \frac{\text{Mass weighted average of } (r \times w)}{\bar{R} \times \text{Mass weighted average of } (u)}.$$

* * * * *